US008991447B1

(12) United States Patent
Petersen

(10) Patent No.: US 8,991,447 B1
(45) Date of Patent: Mar. 31, 2015

(54) SHIP OR AIR DEPLOYABLE AUTOMATED BUOY REFUELING STATION FOR MULTIPLE MANNED OR UNMANNED SURFACE VESSELS

(71) Applicant: Scott M. Petersen, Virginia Beach, VA (US)

(72) Inventor: Scott M. Petersen, Virginia Beach, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 14/096,926

(22) Filed: Dec. 4, 2013

Related U.S. Application Data

(60) Provisional application No. 61/840,349, filed on Jun. 27, 2013.

(51) Int. Cl.
*B65B 3/04* (2006.01)
*B67D 7/42* (2010.01)
*B67D 7/04* (2010.01)

(52) U.S. Cl.
CPC ... *B67D 7/42* (2013.01); *B67D 7/04* (2013.01)
USPC ..... 141/387; 141/231; 141/94; 141/95; 114/256; 414/137.9; 441/4

(58) Field of Classification Search
USPC ..... 141/94–95, 231, 234, 351, 382, 141/387–388; 114/125, 382, 267, 256; 414/137.9; 441/4
See application file for complete search history.

(56) References Cited

U.S. PATENT DOCUMENTS

| | | | | |
|---|---|---|---|---|
| 2,963,179 | A | 12/1960 | Kanady et al. | |
| 3,735,722 | A | 5/1973 | Hooper et al. | |
| 3,943,875 | A | 3/1976 | Sanders | |
| 4,067,080 | A * | 1/1978 | Sylverst | 114/256 |
| 4,286,537 | A | 9/1981 | Hvide | |
| 4,356,784 | A | 11/1982 | Waters et al. | |
| 4,506,623 | A * | 3/1985 | Roper et al. | 114/256 |
| 6,101,964 | A * | 8/2000 | Lesesne | 114/256 |
| 6,336,419 | B1 | 1/2002 | Breivik | |
| 6,883,453 | B1 | 4/2005 | Mulhern | |
| 6,932,127 | B2 * | 8/2005 | Samuelsen et al. | 141/387 |
| 6,945,187 | B1 * | 9/2005 | Woodall et al. | 114/256 |
| 7,025,014 | B1 | 4/2006 | Forgach et al. | |
| 7,156,036 | B2 | 1/2007 | Seiple | |
| 7,506,606 | B2 | 3/2009 | Murphy | |
| 7,699,015 | B1 | 4/2010 | Said | |
| 8,020,505 | B1 | 9/2011 | Galway | |
| 8,225,735 | B1 | 7/2012 | Galway | |
| 8,356,567 | B1 | 1/2013 | Gaston et al. | |
| 8,416,732 | B2 | 4/2013 | Bothorel | |
| 2012/0150364 | A1 | 6/2012 | Tillotson et al. | |
| 2012/0317996 | A1 * | 12/2012 | Lee | 62/50.1 |

* cited by examiner

*Primary Examiner* — Timothy L Maust
*Assistant Examiner* — Timothy P Kelly
(74) *Attorney, Agent, or Firm* — Dave A. Ghatt

(57) ABSTRACT

A fueling system including a ship or air deployable automated fueling station and one or more sea surface water vessels. The fueling station including a ballast arrangement to maintain an optimal freeboard for fueling the one or more water vessels, the fueling station and the one or more water vessels including a communication arrangement for communications between the fueling station and the one or more water vessels. The fueling station including a plurality of nozzles for simultaneously fueling a plurality of water vessels.

14 Claims, 3 Drawing Sheets

SHIP OR AIR DEPLOYABLE AUTOMATED BUOY REFUELING STATION FOR MULTIPLE MANNED OR UNMANNED SURFACE VESSELS

CROSS-REFERENCE TO RELATED APPLICATIONS

This application claims the benefit of U.S. Provisional Patent Application 61/840,349, filed Jun. 27, 2013, titled, Hummingbird Fueling station for Sea Surface Water Vessels, which is herein incorporated by reference. This application is also related to U.S. Non-Provisional Patent Application, application Ser. No. 13/929,527 now U.S. Pat. No. 8,943,992, filed concurrently with the above-cited U.S. Provisional Patent Application, also filed Jun. 27, 2013, titled "Remote Autonomous Refueling Buoy for Sea Surface Craft", hereby incorporated herein by reference.

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

TECHNICAL FIELD

The following description relates generally to a fueling system including a ship or air deployable automated fueling station and one or more sea surface water vessels, the fueling station including a ballast arrangement to maintain an optimal freeboard for fueling the one or more water vessels, the fueling station and the one or more water vessels including a communication arrangement for communications between the fueling station and the one or more water vessels.

BACKGROUND

This invention is directed towards a class of surface water vessels that include aluminum hulled vessels of about 40 feet that displace over 20,000 pounds of water. These vessels may be unmanned surface vessels (USVs) may be powered by diesel engines and twin propellers or waterjets. The fuel capacity is generally 400 to 800 gallons which translates to a limited endurance while performing the mission for which they were designed. All must be brought to the mission area by a larger host vessel.

Generally, each USV must be retrieved from the sea and brought on board the host vessel to be refueled. This reduces the percentage of time the USVs are conducting their mission, reducing their effectiveness and also causes the host vessel to remain relatively close to the mission area. While recovering, the host vessel may be restricted in course and speed, unable to launch and recover other USVs, and not able to operate other systems, which limits its efficiency. If the host vessel can only launch/recover one USV at a time (as is typically the case), this creates a queuing problem for groups of USVs and subtracts from the total mission time available as all must wait while each unit is replenished and re-launched before returning to the mission area. Deteriorating sea conditions may make recovery difficult, dangerous, or impossible and disrupt the USVs mission.

Recently, the U.S. Navy has been developing and working on arrangements for the at-sea refueling of USVs. There are many difficulties associated with open-water refueling, such as for example, unpredictable sea states, and difficulty in obtaining a proper connection between the USV and the fueling station to avoid spillage. It is therefore desired to have an at sea refueling station that overcomes the pitfalls of at-sea refueling, and obviates the need for using a host vessel to provide this service, allowing the host vessel to conduct other missions simultaneously or stand off from a potentially hazardous area.

SUMMARY

In one aspect, the invention a fueling system for securing and fueling a plurality of water vessels at a fueling station. In this aspect, the fueling system includes a fueling station. The fueling station has a fuel receptacle therein, a plurality of fuel nozzles, each of the plurality of fuel nozzles having a probe receiving area for receiving a probe therein. The fueling station also includes a plurality of conduits, wherein each of the plurality of conduits has an end in the fuel receptacle and another end connected to one of the fuel nozzles. The fueling station also includes a fuel sensor positioned within the fuel receptacle for determining the level fuel therein. The fueling station also a GPS receiver that calculates the geographic position of the fueling station, and a latching sensor at each of the plurality of nozzles for determining if a water vessel probe is securely attached thereto. In this aspect, the fueling system also includes a plurality of water vessels, each of the plurality of water vessels having a probe, each probe for positioning within a respective one of the probe receivers, wherein when each probe receiving fuel from the fuel receptacle via the fuel conduit. The fueling station also includes a ballast arrangement for maintaining the fueling station at a predetermined freeboard.

In another aspect, the invention is a ship or air deployable automated fueling station. In this aspect, the ship or air deployable automated fueling station includes a fuel receptacle therein, and a plurality of fuel nozzles. Each of the plurality of fuel nozzles has a probe receiving area for receiving a probe therein. The fueling station also includes a plurality of conduits, wherein each of the plurality of conduits has an end in the fuel receptacle and another end connected to one of the fuel nozzles. In this aspect, the fueling station also has a fuel sensor positioned within the fuel receptacle for determining the level fuel therein. Also included, is a GPS receiver that calculates the geographic position of the fueling station, and a latching sensor at each of the plurality of nozzles for determining if a water vessel is attached thereto. In this aspect, the ship or air deployable automated fueling station has a ballast arrangement for maintaining the fueling station at a predetermined freeboard.

BRIEF DESCRIPTION OF THE DRAWINGS

Other features will be apparent from the description, the drawings, and the claims.

DETAILED DESCRIPTION

Figure 1:
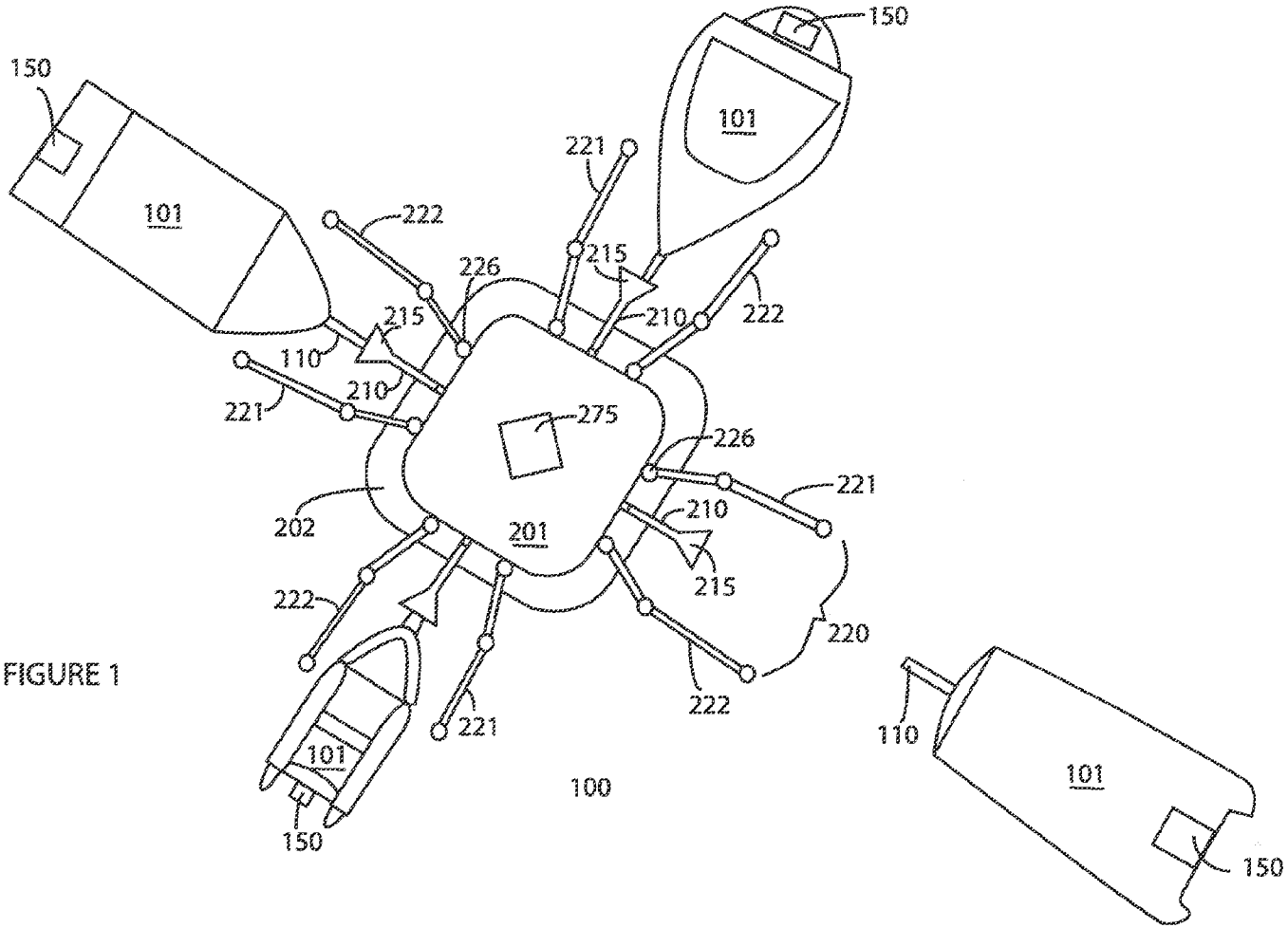
FIG. 1 is a schematic top view illustration of a hummingbird fueling system for securing and fueling a plurality of water vessels at a fueling station according to an embodiment of the invention.

FIG. 1 is a schematic top view illustration of a hummingbird fueling system 100 for securing and fueling a plurality of water vessels 101 at a fueling station 201 according to an embodiment of the invention. FIG. 1 schematically shows a plurality of surface water vessels 101, each water vessel having a propulsor arrangement 150. The propulsion arrangement 150 may include waterjet propulsion, propeller propulsion, or any other known propulsion means, or combinations thereof. The propulsion arrangement 150 may also include guiding elements such as rudders or moveable propulsors for directing the water vessel 101 in a desired direction. Each water vessel 101 may be a manned or an unmanned surface vessel, each having a forwardly projecting elongated probe 110 at the bow of the water vessel 101. It should be noted that the water vessels 101 may have different shapes and dimensions. The probe 110 may be pivotally attached at the bow, where it pivots between a stowed position and a deployed position. The probe 110 is used to secure the water vessel 101 to the fueling station 201. When secured to the fueling station 201, fuel may be supplied to the water vessel 101 through the probe 110, as outlined in U.S. Pat. No. 8,225,735, which is herein incorporated by reference in its entirety.

FIG. 1 also shows the fueling station 201 having a chassis 202, and partition to provide buoyancy void 203. The fueling station 201 may have a variety of shapes with a symmetry that allows for good balance and floating on the water. According to one embodiment, the fueling station 201 has a quarter symmetry. The fueling station 201 may be a buoy having nozzles 210 through which fuel is fed to the probe 110 of the respective water vessel. As shown, each nozzle 210 has a conical front/funnel shaped member 215 to guide the probe 110 into the nozzle 210 into a probe receiving area of the nozzle for receiving and securing the probe therein. Each nozzle 210 also includes a latching sensor 217 (see FIG. 2) at the probe receiving area 216 of each of the plurality of nozzles for determining if a water vessel probe is securely attached within the nozzle 210. As outlined below, each nozzle 210 may also include overlapping tubular elements forming a panographic arrangement, which may be connected to an actuator. When actuated, the panographic arrangement will allow for vertical adjustment to accommodate for the effects of wave motion on the bow of the vessel to facilitate latching.

FIG. 1A also shows a plurality of guiding assemblies 220, each guiding assembly comprising a pair of guide arms (221, 222). As shown, one arm 221 of the pair extends from one side of one of a nozzle 210, and the other arm 222 of the pair extends from the other side of the nozzle. Each arm 221 and 222 may be pivotally attached to the chassis 202 via pivotable joints 226, and may include two or more folding links so that the arms (221, 222) may be folded when not deployed. Because the fueling station 201 has a plurality of nozzles 210, multiple water vessels 101 may be fueled simultaneously. Although FIG. 1 shows four nozzles 210 and accompanying guiding assemblies 220, it is within the scope of the invention to have more than four or less than four nozzles 210 and guides assemblies 220 for accommodating water vessels 101.

Figure 2:
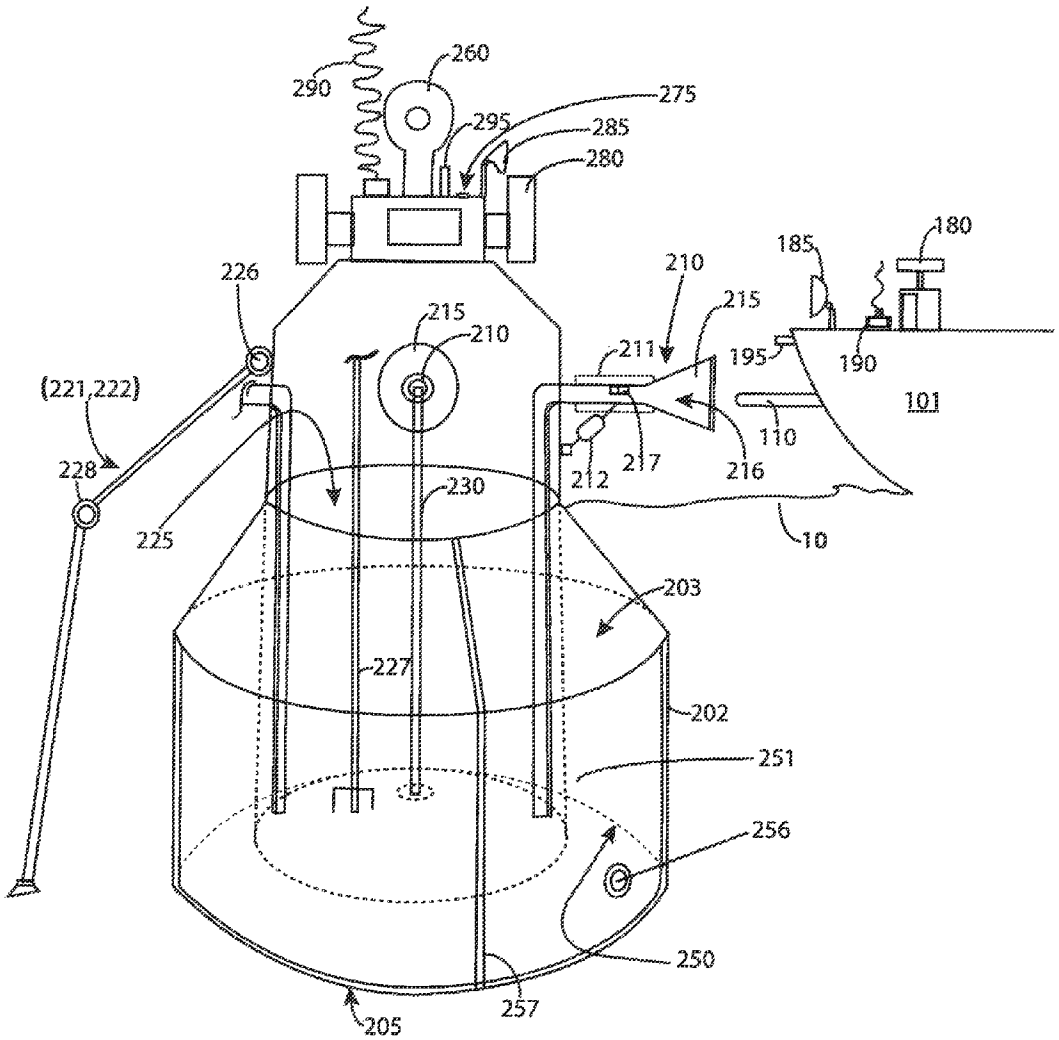
FIG. 2 is a schematic illustration of a hummingbird fueling system for securing and fueling a plurality of water vessels at a fueling station according to an embodiment of the invention.

FIG. 2 is a schematic view of the hummingbird fueling system 100 for securing and fueling a plurality of water vessels 101 at a fueling station 201 according to an embodiment of the invention. FIG. 2 shows the chassis 202 having a bell-like shape, which as outlined above is preferably quarter symmetrical. Although not a cube, at its widest portions, the fueling station 201 may have dimensions of about 10 ft.×10 ft.×10 ft. to about 15 ft.×15 ft.×15 ft. FIG. 1B shows the fueling station 201 having a fuel tank/receptacle 225 for holding fuel, located at a lower portion of the chassis 202. This shape, including the symmetry adds stability to the fueling station. Additionally, the chassis 202 has a wide flat base 205, which allows the fueling station 201 to sit stably in an aircraft or on a flat ship deck. Additionally, the guides 221 and 222, shown in FIG. 1, are pivotable downwards via the pivotable joints 226 and 228, which allows the guides 221 and 222 to act as legs to enhance the balance of the fueling station 201 when it is stored in an aircraft or on a flat ship deck. It should be noted that for illustrative purposed only FIG. 2 only illustrates one guide, which is representative of any guide (221, 222), extending downwards acting as a support leg. The fuel receptacle may hold up to several thousand gallons of water as ballast. It should be noted however, as stated above, other chassis shapes are within the scope of this invention.

FIG. 2 also shows the nozzles 210 and conical member 215. As shown, the nozzles may include overlapping tubular members that form a panographic arrangement 211 allowing for extension outwards toward the probe. An actuator 212 may be used to actuate the panographic arrangement 211. As shown, the nozzles include a receiving area 216 for receiving a probe 110 therein. Also shown is a latching sensor 217 for detecting when a probe 110 is latched within the receiving area 216. The latching sensor 217 may include one or more proximity sensors, wherein detections are made based on the relative positions of the respective nozzle 210 and probe 110.

As illustrated, conduits 230 extend from within the fuel receptacle 225 up to the nozzles. In operation, the conduits provide fuel from the fuel receptacle 225 to the nozzles 210, to the water vessels 101, via their respective probes 110. Although not illustrated, known pumps and valves may be employed to pump the fuel through the conduits 230. FIG. 2 also shows a fuel level sensor 227 within the fuel receptacle 225, for sensing the amount of fuel in the fuel receptacle 225.

FIG. 2 shows a ballast tank 250 partitioned from the fuel receptacle 225, via partition wall 251, which extends down towards the base 205 of the device to allow for varying ballast as fuel is depleted. The ballast tank 250, along with other elements of a ballast arrangement are used to maintain the fueling station 201 at a desired freeboard or vertical height with respect to the waterline 10 surrounding the fueling station 201. The ballast arrangement also includes a water intake/outtake assembly 256, to take in or expunge water from the ballast tank. Although not illustrated, the ballast tank arrangement includes a conventional pumping or self-filling arrangement as fuel is depleted. The ballast arrangement also includes a ballast level sensor 257 for sensing the water level inside the ballast tank 250. As outlined below with respect to FIG. 3, the ballast sensor 257 and the fuel level sensor 227 communicate with a controller to maintain the fueling station at a desired vertical height/freeboard.

FIG. 2 shows a communications block 275, located at the topmost part of fueling station 201. The communications block 275 includes communications elements for communicating between the fueling station 201 and the plurality of water vessels 101. Included are long range communication elements, which includes one or more long range transponders 280 for communications, primarily sharing GPS (location) information for calculating course of craft to intercept the fueling station 201. Communications may be via Radio Frequency (RF) communication Line of Sight (LOS) and may be facilitated by a range of radios capable of transmitting small packets of information. Satellite Communications (SATCOM) is an alternative to extend communications out beyond the horizon. The long range transponders 280 on the fueling station communicate with corresponding long range transponders 180 on the plural of water vessels 101. Together the long range transponders 280 and 180 form a wireless data link. Long range communications may take place, starting at a distance of about 15 nautical miles. Thus, long range communications between the fueling station 201 and a water vessel may be enabled when they are 15 nm miles apart, and may continue to when they are in contact with each other.

The communications block 275 also includes medium range communication elements, such as a radar 285 for communications within about a several hundred feet, with the water vessels 101 having corresponding radars 185. Together the medium range radars 285 and 185 form a medium range communication arrangement conventionally used for docking operations. The communications block 275 may also include short range communication devices, such as transponders 295 for communicating with the water vessels 101 within about 10 feet for fine adjustment of the funnel 215 via actuation of the panographic arrangement 211 with the actuator 212. The water vessels 101 would also have corresponding transponders 195, the two transponders 295 and 195 forming a short range communication arrangement. Alternatively, as shown in FIG. 2 the short range transponders 295 may be positioned lower down on the chassis 202, closer to the nozzle 210 for more efficient communication between the fueling station 201 and the respective water vessel 101. The short range communication device including transponders 295 and 195 may implement known technology such as electro-optical and/or infrared spectrums for providing kinematic positioning of the fueling elements. FIG. 2 also shows the fueling station 201 having a GPS receiver 290 for calculating the geographic location of the fueling station 201. The water vessels 101 also include a GPS receiver 190 for calculating their geographic location.

FIG. 2 also shows a lift hook 260 at the top of the fueling station 201. The lift hook may be used to lift and deploy the fueling station 201. As stated above, although not a cube, at its widest portions, the fueling station 201 may have dimensions of about 10 ft.×10 ft.×10 ft. to about 15 ft.×15 ft.×15 ft., and may carry several thousand gallons of fuel. Given its size and the weight of the fuel, the fueling station 260 may be deployed by a helicopter, which lifts the fueling station 201 by the lift hook 260. Alternatively, the fueling station may be deployed by a large parent ship on which it is stored. Thus, the fueling station may be slid off the ramp, or may be lifted off the ship deck and placed the water by means of a crane that carries the fueling station 201 by the lift hook 260.

Figure 3:
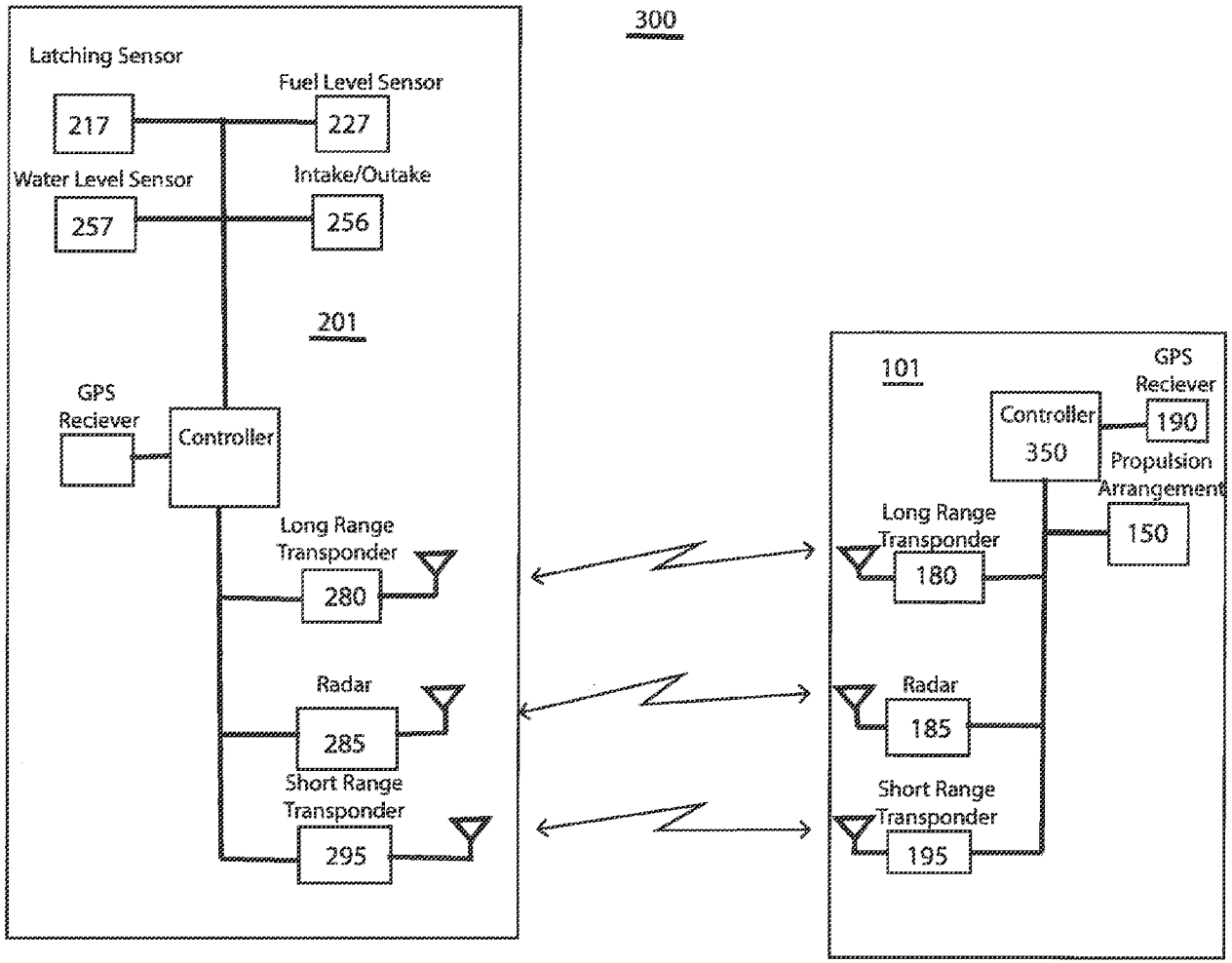
FIG. 3 is an exemplary controller arrangement for the hummingbird fueling system, according to an embodiment of the invention.

FIG. 3 is a schematic illustration of a controller arrangement 300 for the fueling system 100, according to an embodiment of the invention. As outlined with respect to FIG. 1, the fueling system 100 includes a fueling station 201 and one or more water vessels 101. It should be noted that the controller arrangement 300 of FIG. 3 is not an all-inclusive list of the control features of the fueling system, but merely highlights some control features, such as the control of the ballast arrangement and communications between the fueling station 201 and the one or more water vessels 101.

FIG. 3 shows a fueling station controller 301, which may be a programmable microprocessor, which controls the operations of the fueling station 201. The controller is electronically connected to different elements of the ballast arrangement, including the water intake/outtake assembly 256, and the ballast level sensor 257 for sensing the water level inside the ballast tank 250. The controller is also connected to the fuel level sensor 227. FIG. 3 also shows the controller 301 connected to the long range transponders 280, radars 285, and transponders 295. The controller 301 is also connected to the GPS receiver 290.

FIG. 3 also shows one of the one or more water vessels 101. As shown, each of the one or more water vessels includes a controller 350, which may be a programmable microprocessor that controls the operations of the respective water vessel 101. The vessel controller 350 is electronically connected to a propulsion arrangement 150. As stated above, the propulsion arrangement 150 may include waterjet propulsion, propeller propulsion, or any other known propulsion means, or combinations thereof. The propulsion arrangement 150 may also include guiding elements such as rudders or moveable propulsors for directing the water vessel 101 in a desired direction. The vessel controller 350 is also connected to the long range transponder 180, radar 185, and short range transponder 195. The controller 350 may also be connected to the vessel GPS receiver 190, which determines the location of the water vessel 101. Vessel controller 350 coupled to the long range transponder 180 allows for remote monitoring of any desired craft/vessel system parameters, and in the case of a Unmanned Surface Vehicle (USV) is the data link for control.

One of the benefits of the fueling system 100 is the ability to maintain the fueling station 201 at a predetermined freeboard or vertical height with respect to the surrounding water. As stated above, the ballast tank 250, along with other elements of a ballast arrangement are used to achieve this goal. The ballast sensor 257 and the fuel level sensor 227 communicate with the controller 301 to maintain the fueling station at a desired vertical height/freeboard. In operation, the controller 301 is programmed to correlate a known fuel level in the fuel tank 225 with a known water level in the ballast tank 250, the amount of fluid contained in one tank, counterbalances the amount in the other, thereby resulting in a desired freeboard. Consequently, as fuel from the fuel tank 225 is removed, water is added to the ballast tank 250 to make up for this loss of fuel. If fuel is added to the tank 225, then water is removed from the ballast tank 250. In response to a change in the fuel level, the controller 301 actuates the ballast intake/outtake assembly 256 to either add or remove water from the ballast tank 250. The amount of water added or removed from the ballast tank 250 is determined by the change in the fuel level detected by sensor 227. Based on readings from the ballast level sensor 257, the controller 301 determines when the appropriate amount of water is added or removed from the tank 250.

Another benefit of the fueling system 100 is the ability to have remotely located water vessels 101 communicate with the fueling station 201. This allows the one or more water vessels 101 and the fueling station 201 to find each other over a distance, exchange information such as location data, fuel level data, and latched vessel data indicating the number of water vessels being fueled at the fueling station. Based on the exchanged information, fueling-related determinations are made, such as whether to proceed to the fueling station 201 to receive fuel. The fueling system 100 is equipped to exchange the relevant information and perform fueling activities because of the communication system.

As stated above, the fueling system 100 includes a communication system having a long range communication arrangement, a medium range communication arrangement for communications within about a several hundred feet, and a short range communication arrangement for communicating within about 10 feet for directing the water vessels into the fueling station so that the respective probe 110 enters the respective nozzle 210. As outlined with respect to FIG. 3, the controller 301 is electronically connected to the communication elements 280, 285, 290, and 295, located on the fueling station 201. The controller 301 may also receive and exchange information with the one or more water vessels 101 and a host ship or other control platform, via communication elements located on the one or more water vessels 101.

Regarding the long range communications, the controllers 301 and 350 may communicate relative positions of the fueling station 201 and the one or more water vessels 101. The GPS receivers 290 and 190 may calculate their respective positions based on radio signals received from a number of navigation satellites. Thus, for example via the above-mentioned data link, the transponder 280 at the fueling station 201 may send location data, i.e., its GPS location calculated by GPS receiver 290, to one of the water vessels 101, which is received by the transponder 180. The transponder 280 may also send information such as, the amount of fuel in the tank 225 as detected by sensor 227. The transponder 280 may also send data pertaining to the number of vessels 101 that are currently latched and being fueled at the fueling station 201. This information is ascertained by means of the plurality of latching sensors 217 located within the receiving area of the nozzles 210. All this data is received by the water vessel 101 via the transponder 180. As illustrated and as outlined above, the fueling station 201 is equipped to fuel a plurality of water vessels 101 simultaneously. Thus, depending on the number of vessels 101 currently being fueled, and the amount of fuel remaining in the tank 225, the fueling station 201 may or may not be able to accommodate another water vessel 101. Consequently, based on the data received the vessel controller 350 determines whether to proceed to the fueling station 201 to receive fuel. If the controller 350 decides to proceed to fueling, based on GPS data received from the fueling station 201 and GPS location data from the vessel receiver 190, the controller 350 generates navigation instructions to guide the water vessel 101 to the fueling station 201. As the water vessel 101 proceeds towards the fueling station 201, the GPS data may be updated by receivers 290 and 190 at regular intervals, to ensure that the vessel 101 is on path to the fueling station 201. As the GPS data is updated, the navigation instructions may also be updated.

As stated above, the communication arrangement also includes a medium range communication arrangement for communications within about a several hundred feet. In operation, when a water vessel 101 is approaching the fueling station 201, when the water vessel gets within about 1,200 ft. to about 800 ft. a data link can be established and the long range communications hands off to the medium range communications. Thus, medium range communications between the fueling station 201 and a water vessel may be enabled when they are 1,200 ft. to about 800 ft. apart, and may continue to when they are in contact with each other. The medium range communications may be radars 285 and 185, located on the fueling station 201 and the water vessel 101, respectively. The radars 285 and 185 communicate with greater precision than the long ranged. Based on exchanged radar signals, the water vessel 101 travels from several hundred feet out, towards the guide arms 221 and 222, shown in FIG. 1.

The guide arms 221 and 222 help to direct the water vessel towards the nozzle at the fueling station 201. The short range communications takes over at this point, with the transponders 295 and 195 communicating to provide the precision necessary to direct the vessel probe 110 within the nozzle 210. Once the probe 110 is inserted into the nozzle 201, the probe may be latched therein, and signal is sent to the fueling station controller 301 notifying that the probe 110 is securely latched therein. This information is sent to the controller 301 by latching sensors 217 located within the receiving area of the nozzles 210. This latching and signaling system is outlined in U.S. Pat. No. 8,225,735, which as stated above, is incorporated by reference in its entirety.

What has been described and illustrated herein are preferred embodiments of the invention along with some variations. For example, other known communications systems may be used, such as SATCOM, VHF, HF, or the like. The terms, descriptions and figures used herein are set forth by way of illustration only and are not meant as limitations. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. A fueling system for securing and fueling a plurality of water vessels at a fueling station, the fueling system comprising:

a fueling station comprising;

a fuel receptacle therein, a plurality of fuel nozzles, each of the plurality of fuel nozzles having a probe receiving area for receiving a probe therein, a plurality of conduits, wherein each of the plurality of conduits has an end in the fuel receptacle and another end connected to one of the fuel nozzles, a fuel sensor positioned within the fuel receptacle for determining the level fuel therein;

a GPS receiver that calculates the geographic position of the fueling station;

a latching sensor at each of the plurality of nozzles for determining if a water vessel is attached thereto;

a fuel station controller;

a ballast arrangement for maintaining the fueling station at a predetermined freeboard, wherein the ballast arrangement comprises:

a ballast tank;

a water intake/outtake assembly to take in or expunge water from the ballast tank; and a ballast sensor for sensing the water level inside the ballast tank, wherein the fuel sensor, the ballast sensor, and the water intake/outtake assembly are connected to the fuel station controller; and wherein, in response to a change in fuel level determination by the fuel sensor, the controller provides signal controls that initiates the water intake/outtake assembly to either intake or expunge water to maintain the fueling station at the predetermined freeboard;

a plurality of water vessels, each of the plurality of water vessels comprising a probe, each probe for positioning within a respective one of the probe receivers, wherein when each probe receiving fuel from the fuel receptacle via the fuel conduit.

2. The fueling system of claim 1 further comprising a communication system for communicating between the plurality of water vessels and the fueling station, the communication system comprising:

a long range communication arrangement for communications starting from about 15 nautical miles;

a medium range communication arrangement for communications starting from about 1,200 ft. to about 800 ft.; and a short range communication arrangement for communications starting from about 10 ft. for directing the water vessels into the fueling station so that the respective probe enters the respective receiver.

3. The fueling system of claim 2, wherein each of the plurality of water vessel comprise a vessel controller for controlling vessel operations, and wherein via the long range communication arrangement, the fueling station communicates station status data, said station status data comprising; GPS location data, fuel level data, and latched vessel data indicating the number of water vessels being fueled at the fueling station, and wherein based on the station status data, each said water vessel controller determines whether to proceed to the fueling station to receive fuel.

4. The fueling system of claim 3, wherein the fueling system comprises a plurality of guiding assemblies, each guiding assembly comprising a pair of guide arms, wherein one arm of the pair extends from one side of one of the plurality of nozzles, and the other arm of the pair extends from the other side of said one of the plurality of nozzles.

5. The fueling system of claim 4, wherein in the communication system, the long range communication arrangement is a wireless data link that comprises one of long range transponders, the medium range communication arrangement comprises a radar based system, and the short range communication arrangement comprises short ranged transponders.

6. The fueling system of claim 5, further comprising a wide flat base for storing the fueling station on a flat surface on a ship or aircraft, wherein each guide arm of the plurality of guiding assemblies pivots downwards to act as support legs when the fueling station is stored on a flat surface.

7. The fueling system of claim 6, further comprising a lift hook at the top of the fueling station for holding and deploying the fueling station from a ship or aircraft into the water.

8. The fueling system of claim 7, wherein the fueling station comprises four fuel nozzles.

9. A ship or air deployable automated fueling station comprising:

a fuel receptacle therein, a plurality of fuel nozzles, each of the plurality of fuel nozzles having a probe receiving area for receiving a probe therein, a plurality of conduits, wherein each of the plurality of conduits has an end in the fuel receptacle and another end connected to one of the fuel nozzles, a fuel sensor positioned within the fuel receptacle for determining the level fuel therein;

a GPS receiver that calculates the geographic position of the fueling station;

a latching sensor at each of the plurality of nozzles for determining if a water vessel is attached thereto;

a fuel station controller;

a ballast arrangement for maintaining the fueling station at a predetermined freeboard, wherein the ballast arrangement comprises:

a ballast tank;

a water intake/outtake assembly to take in or expunge water from the ballast tank; and a ballast sensor for sensing the water level inside the ballast tank, wherein the fuel sensor, the ballast sensor, and the water intake/outtake assembly are connected to the fuel station controller; and wherein, in response to a change in fuel level determination by the fuel sensor, the controller provides signal controls that initiates the water intake/outtake assembly to either intake or expunge water to maintain the fueling station at the predetermined freeboard.

10. The ship or air deployable automated fueling station of claim 8, further comprising a communication system for communicating with a plurality of water vessels, the communication system comprising:

a long range transponder for communications starting from about 15 nautical miles;

a medium range radar for communications starting from about 1,200 ft. to about 1,000 ft.; and a short range transponder arrangement for communicating starting from about 10 ft. for directing water vessels into the fueling station.

11. The ship or air deployable automated fueling station of claim 10, and wherein via the long range transponder, the fueling station communicates station status data, said station status data comprising; GPS location data, fuel level data, and latched vessel data indicating the number of water vessels being fueled at the fueling station.

12. The ship or air deployable automated fueling station of claim 11, wherein the fueling station comprises a plurality of guiding assemblies, each guiding assembly comprising a pair of guide arms, wherein one arm of the pair extends from one side of one of the plurality of nozzles, and the other arm of the pair extends from the other side of said one of the plurality of nozzles.

13. The ship or air deployable automated fueling station of claim 12, further comprising a wide flat base for storing the fueling station on a flat surface on a ship or aircraft, wherein each guide arm of the plurality of guiding assemblies pivots downwards to act as support legs when the fueling station is stored on a flat surface.

14. The ship or air deployable automated fueling station of claim 13 wherein the fueling station comprises four fuel nozzles.

* * * * *